US009583091B2

(12) United States Patent
Lennstrom

(10) Patent No.: US 9,583,091 B2
(45) Date of Patent: Feb. 28, 2017

(54) METHOD AND SYSTEM FOR MASKING NOISE

(71) Applicant: VOLVO CAR CORPORATION, Gothenburg (SE)

(72) Inventor: David Lennstrom, Gothenburg (SE)

(73) Assignee: Volvo Car Corporation, Gothenburg (SE)

( * ) Notice: Subject to any disclaimer, the term of this patent is extended or adjusted under 35 U.S.C. 154(b) by 313 days.

(21) Appl. No.: 14/536,055

(22) Filed: Nov. 7, 2014

(65) Prior Publication Data

US 2015/0131808 A1 May 14, 2015

(30) Foreign Application Priority Data

Nov. 8, 2013 (EP) ..... 13192053

(51) Int. Cl.
*H04R 3/02* (2006.01)
*G10K 11/175* (2006.01)

(52) U.S. Cl.
CPC ..... *G10K 11/175* (2013.01)

(58) Field of Classification Search
CPC ..... G10K 11/175
USPC ..... 381/73.1
See application file for complete search history.

(56) References Cited

U.S. PATENT DOCUMENTS

2006/0009969 A1 1/2006 L'Esperance et al.
2012/0076314 A1* 3/2012 Reilly ..... G10K 15/02 381/71.4

OTHER PUBLICATIONS

Extended European Search Report for European Application No. 13192053.0, Completed by the European Patent Office, Dated Mar. 7, 2014, 7 Pages.
Lennstrom et al. Inter Noise, Noise Control for Wuality of Life Sep. 15-18, 2013, 8 Pages, "Prominence of Tones in Electric Vehicle Interior Noise".

* cited by examiner

*Primary Examiner* — Paul S Kim
(74) *Attorney, Agent, or Firm* — Brooks Kushman P.C.

(57) ABSTRACT

A method is disclosed for masking noise originating from rotary equipment in a vehicle engine. The method may include checking if engine input conditions fulfill engine input condition threshold values. If the engine input conditions fulfill the engine input conditions threshold values, the method may include outputting a first masking noise from a speaker. The first masking noise may include a first central frequency, a first predetermined bandwidth and a first amplitude, where the first central frequency and the first amplitude are determined by the input conditions. The disclosure also relates to a system for masking noise originating from rotary equipment in a vehicle engine.

17 Claims, 3 Drawing Sheets

METHOD AND SYSTEM FOR MASKING NOISE

CROSS-REFERENCE TO RELATED APPLICATIONS

This application claims foreign priority benefits under 35 U.S.C. §119(a)-(d) to European patent application number EP 13192053.0, filed on Nov. 8, 2013, which is incorporated herein by reference in its entirety.

TECHNICAL FIELD

The disclosure relates to a method and system for masking noise originating from rotary equipment in a vehicle engine.

BACKGROUND

Noise is a big source of concern in today's society. Various types of machines emit sounds of various frequencies. Certain frequencies having a certain sound pressure level are considered noise and must due to for instance regulations be removed or reduced to below an allowable sound pressure level.

One example of such a machine is any type of engine, pump or similar emitting noise which cannot be dampened or absorbed with standard sound absorbing or noise reducing means, such as resonators or insulation.

A vehicle engine running at a specific engine rpm causes a rotary equipment such as a supercharger, fan, pump, generator, compressor or other similar equipment to emit a specific noise frequency proportional to the rotational frequency of the rotary equipment or rotary equipment rpm. The engine itself can also be seen as a rotary equipment, for instance in the case of electric motors. As the rotational frequency of the rotary equipment is coupled to the engine rpm a specific noise frequency having a frequency being determined by the engine rpm is emitted. The specific noise frequency is thus determined by engine input conditions such as rpm and/or other factors. Such a specific noise frequency usually has an amplitude which causes the specific noise frequency to be easily distinguishable over the ambient broadband sound originating from for instance the combustion engine, wheels and wind.

It is not always possible to absorb or reduce these specific noise frequencies by ordinary means such as resonators or insulation. If the specific noise frequency is of a low frequency, i.e. below approximately 300 Hz, active noise control can be utilized and a signal having the same frequency as the specific noise frequency can be output out of phase with the specific noise frequency, thereby cancelling the specific frequency. However, this is not possible for specific noise frequencies over certain frequencies, e.g. above approximately 300 Hz.

There is thus a need for an improved method of dealing with unwanted specific noise frequencies, especially for specific noise frequencies which cannot be cancelled by active noise control or ordinary forms of damping or insulation.

SUMMARY

The object of the present disclosure is to provide an inventive method and system for masking noise originating from rotary equipment in a vehicle engine. This object is achieved by the features of the characterizing portion of claims 1 and 9. Additional features of the disclosure are set out in the dependent claims.

The disclosure relates to a method for masking noise originating from rotary equipment in a vehicle engine. The method comprises:

checking if one or more engine input conditions fulfill engine input condition threshold values, wherein, if said one or more engine input conditions fulfill said engine input conditions threshold values, outputting a first masking noise from at least one speaker, wherein the first masking noise comprises a first central frequency, a first predetermined bandwidth and a first amplitude, wherein the first central frequency and the first amplitude is determined by said input conditions.

A specific noise frequency is a tonal sound or noise, i.e. a single frequency or a very narrowband sound source. An advantage with the method is that by outputting a masking noise comprising frequencies surrounding the specific noise frequency in a first bandwidth, the specific noise frequency is perceived to be less prominent than otherwise. This is based on psychoacoustics. The more outstanding or prominent a specific noise frequency is, i.e. the greater the difference is in sound level, from sound comprising a broadband spectrum the easier it is for the human ear to perceive. Also, a specific noise frequency is more easily perceived as annoying than background or ambient broadband sound. By outputting a masking noise wherein the first masking noise comprises a first central frequency, a first bandwidth and a first amplitude, wherein the first central frequency and the first amplitude is determined by said input conditions, the masking noise reduces the amplitude difference between the specific noise frequency and the ambient broadband sound surrounding the specific noise frequency in the first bandwidth causing the perceived prominence of the specific noise frequency to be reduced. The method is used together with present engine sound design in order to maintain an audibly appealing engine sound.

Rotary equipment in this application comprises rotary equipment connected to a vehicle engine such as for instance a supercharger, fan, pump, generator, compressor or other similar equipment. Rotary equipment can also comprise the whole engine itself or interior parts of the engine itself, for instance in the case of electric motors.

The method may further comprise:

measuring a sound spectrum originating from said rotary equipment and said vehicle engine inside a compartment by means of at least one microphone, calculating a first tone/noise amplitude ratio between the amplitude of a first specific noise frequency determined by said input conditions and the amplitude of ambient sound in a DSP from the measured sound spectrum, wherein if the first tone/noise amplitude ratio exceeds a predetermined tone/noise amplitude ratio threshold value, outputting a first masking noise from the at least one speaker, wherein the first masking noise comprises a first central frequency, a first bandwidth and a first amplitude, wherein the first central frequency is the first specific noise frequency, and the first amplitude is determined by the tone/noise amplitude ratio.

By using one or more microphones which are arranged to record a sound spectrum present inside a vehicle compartment, the method can be made more responsive to the actual sound present in the compartment. The sound spectrum recorded by the microphone contains ambient broadband sound and one or more specific noise frequencies originating from at least one rotary equipment. A first tone/noise amplitude ratio can be calculated between the amplitude of a first specific noise frequency and the amplitude of ambient broadband sound. If the tone/noise amplitude ratio exceeds a predetermined first tone/noise amplitude ratio threshold value in addition to that the above mentioned engine input conditions fulfill the engine input condition threshold values a masking noise is outputted by the speaker. The amplitude of the masking noise is determined by the tone/noise amplitude ratio. The measurements are performed continuously such that the masking noise is continuously adapted to match the varying specific noise frequencies that changes due to varying engine input conditions.

The method may comprise:

checking in an ECU the one or more engine input conditions fulfill engine input condition threshold values, wherein, if said one or more engine input conditions fulfill said engine input conditions threshold values, providing from the ECU to a DSP comprising a noise generator and at least one band pass filter said engine input conditions, providing from the DSP to the noise generator a first masking noise signal, wherein the first masking noise signal is a band pass filtered noise signal, outputting a first masking noise from said at least one speaker having a frequency spectrum matching the provided band pass filtered noise signal by means of the noise generator.

The method may comprise:

outputting a second masking noise from the at least one speaker together with the first masking noise, wherein the second masking noise comprises a second central frequency, a second bandwidth and a second amplitude, wherein the second central frequency is correlated to said engine input conditions and the second amplitude is correlated to said engine input conditions or a calculated second tone/noise amplitude ratio between the amplitude of a second specific noise frequency and the amplitude of ambient sound in a DSP from the measured sound spectrum.

A vehicle engine may not only emit one specific noise frequency, but several. The additional specific noise frequencies are overtones of the specific noise frequency having the lowest frequency. It may thus be advantageous to be able to mask each of these specific noise frequencies.

The method may further comprise:

calculating a first tone/noise amplitude ratio between the amplitude of a first specific noise frequency determined by said input conditions and the amplitude of ambient sound in a DSP from the measured sound spectrum, wherein the tone/noise amplitude ratio is either tone-to-noise ratio (TNR) or prominence ratio (PR). The tone/noise amplitude ratio threshold value may be dependent on engine input conditions and be between 0 and 10 dB, preferably between 0 and 6 dB. The TNR and PR are calculated according to ECMA-74.

Depending on the frequency of the specific noise frequency it is more or less prominent. In the part of the hearing range in which humans are most sensitive (approx. 2000-4000 Hz) the tone/noise amplitude ratio can be lower and the specific noise frequency will still be perceived as prominent over the ambient broadband sound. The tone/noise amplitude ratio threshold value can be the same for all frequencies or different for different frequencies.

The disclosure also relates to a system for masking noise originating from rotary equipment in a vehicle engine. The system may comprise means for checking if engine input conditions fulfill engine input condition threshold values, at least one speaker, and means for generating noise to be output by the at least one speaker. The means for generating noise may comprise a noise generator, noise machine or the like, and may include a processor, memory and stored computer executable instructions for performing various functions and/or operations, such as those described herein. If one or more engine input conditions fulfill said engine input conditions threshold values, the system is arranged to output a first masking noise from at least one speaker, wherein the first masking noise has a first central frequency, a first bandwidth and a first amplitude, wherein the first central frequency and the first amplitude is determined by said input conditions.

The system may further comprise at least one microphone being arranged to measure a sound spectrum inside a compartment. The system may be arranged to calculate a first tone/noise amplitude ratio between the amplitude of a first specific noise frequency determined by said input conditions and the amplitude of ambient sound in a DSP from the measured sound spectrum. If the tone/noise amplitude ratio exceeds a predetermined tone/noise amplitude ratio threshold level, the system outputs a first masking noise from the at least one speaker, wherein the first masking noise has a first central frequency, a first bandwidth and a first amplitude, wherein the first central frequency is the first specific noise frequency, and the first amplitude is determined by the tone/noise amplitude ratio. The latency of the system is preferably less than 100 ms.

The means for checking if engine input conditions fulfill engine input condition threshold values may be an ECU, which may comprise a processor, memory and stored computer executable instructions for performing various functions and/or operations, such as those described herein. The system may be arranged to provide engine input conditions from the ECU to a DSP comprising a noise generator and at least one band pass filter, to provide a first masking noise signal from the DSP to the noise generator, wherein the first masking noise signal is a band pass filtered noise signal and output a first masking noise from the speaker having a frequency spectrum matching the provided band pass filtered noise signal by means of the noise generator.

The system may be arranged to output a second masking noise from the at least one speaker together with the first masking noise, wherein the second masking noise has a second central frequency, a second bandwidth and a second amplitude, wherein the second central frequency is correlated to said engine input conditions and the second amplitude is correlated to said engine input conditions or a calculated second tone/noise amplitude ratio between the amplitude of a second specific noise frequency and the amplitude of ambient sound in a DSP from the measured sound spectrum.

The first masking noise has a bandwidth between 3% and 30% of the first central frequency distributed evenly around the central frequency. The second masking noise has a bandwidth between 3% and 30% of the first central frequency distributed evenly around the central frequency. An advantage of having a limited bandwidth is that the masking noise is perceived to blend with the ambient sound from the engine and other sources in the compartment.

The input conditions may be one or more of:

engine rpm engine torque rotary equipment rpm selected gear vehicle speed, throttle position, wherein the engine rpm threshold value is between 800 rpm and 15000 rpm, the engine torque threshold value is equal to or above 70 Nm the rotary equipment rpm threshold value is between 800 and 16000 rpm selected gear threshold value is above second gear vehicle speed threshold value is above 5 kph

DETAILED DESCRIPTION

As required, detailed embodiments of the present disclosure are disclosed herein. However, it is to be understood that the disclosed embodiments are merely exemplary of the disclosure that may be embodied in various and alternative forms. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

Figure 1:
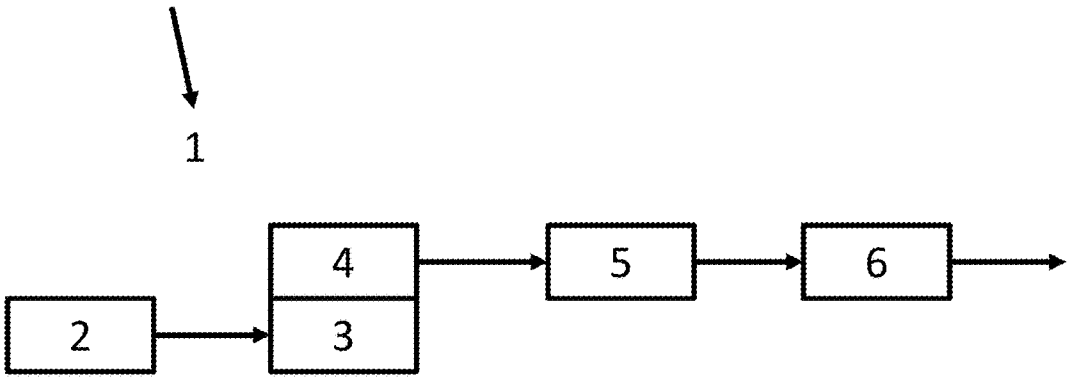
FIG. 1 schematically describes a system according to the disclosure.

FIG. 1 schematically shows a system 1 according to the disclosure. In connection with the system 1 one method according to the disclosure will be described. The system 1 comprises an electronic control unit (ECU) 2 which by means of a CAN bus is arranged to send data to other components in a vehicle, a digital signal processor (DSP) 3 comprising a noise generator 4. The noise generator 4 is connected to an amplifier 5 which in turn is connected to a speaker 6. The ECU/CAN bus in the system 1 are present in modern vehicles. The method is integrated with other engine sound designs by adding a masking noise to the sound output by the engine sound design.

One method according to the disclosure uses information from the ECU 2 wherein engine input conditions are checked to see if they fulfill engine input condition threshold values. If one or more values are fulfilled the speaker 6 outputs a masking noise. The masking noise comprises a first central frequency, a first predetermined bandwidth and a first amplitude, wherein the first central frequency and the first amplitude is determined by said input conditions. Engine input conditions are for instance engine rpm, engine torque, rotary equipment rpm, selected gear, vehicle speed and/or throttle position.

As a non-limiting example, an engine running at 3000 rpm (=50 Hz) may be coupled to a super charger with a ratio of 6.5, meaning that for each revolution the engine makes, the super charger rotates 6.5 revolutions. A super charger having an order of 4 emits a tone having a frequency $$f = \frac{\text{engine } rpm}{60} \cdot 6.5 \cdot \text{order \#} = \frac{3000}{60} \cdot 6.5 \cdot 4 = 1300 \text{ Hz.}$$

The emitted tone usually has accompanying overtones having frequencies which are multiples of the high frequency tone. The multiples are determined by the order or multiple of speeds for the rotary equipment. As a non-limiting example, for a supercharger orders 4, 8, 12 and 16 give rise to unwanted tones.

By receiving engine input conditions from the ECU 2 the DSP 3 can for each engine input condition or combinations of engine input conditions calculate or extract from a look-up table which frequency or frequencies are emitted. The DSP 3 comprises a number of band pass filters which characteristics are dependent on the engine rpm. The DSP 3 further comprises one or more noise generators which are arranged to produce one or more band pass filtered noise signals. The noise generators can be arranged to produce white noise, pink noise, Brown noise, blue noise, violet noise or any other kinds of noise. Noise sources may also be combined in order to further tailor the output noise.

In the case of one tone being emitted, a first band pass filtered noise signal is generated. The first band pass filtered noise signal comprises a first central frequency being the same as the frequency of the emitted tone as calculated or extracted by the DSP and has a first bandwidth which corresponds to between 3% and 30% of the first central frequency, and thereby also to between 3% and 30% of the tone frequency. The first amplitude of the first band pass filtered noise signal is determined by the engine input conditions in a similar way as for the first frequency. The first band pass filtered noise signal is provided from the DSP 3 to the noise generator 4 as a first masking noise signal. The noise generator 4 via the amplifier 5 outputs the first masking noise by means of the speaker 6. The first masking noise thereby has a frequency spectrum matching the first band pass filtered noise signal.

Figure 2:
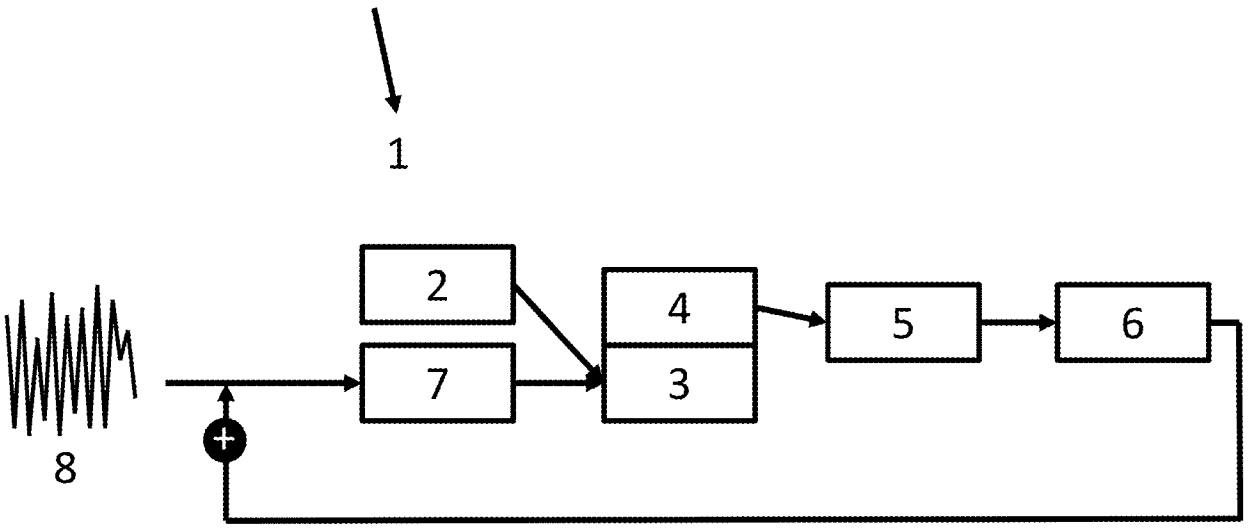
FIG. 2 schematically describes a system according to the disclosure.

FIG. 2 schematically shows a system 1 according to the disclosure. The system 1 is similar to the system in FIG. 1 with the addition of a microphone 7. The microphone 7 is for instance located in the vehicle's interior compartment and can be a microphone used for telephone calls. The system in FIG. 2 is arranged to use the same method as described in conjunction to FIG. 1 with the addition that a first tone/noise amplitude ratio is measured by the microphone 7 and a first tone/noise amplitude ratio threshold condition needs to be fulfilled in addition to engine input conditions for a first masking noise to be outputted by the speaker 6. A first masking noise is thus outputted only if both the tone/noise amplitude ratio and the engine input conditions fulfill their respective threshold values.

A first tone/noise amplitude ratio between the amplitude of a first specific noise frequency determined by said input conditions and the amplitude of ambient sound is calculated in the DSP from a sound spectrum 8 measured by the microphone 7. The first masking noise is provided in the same way as described in FIG. 1. The addition of the microphone 7 allows the amplitude of the first masking noise to be determined by the tone/noise amplitude ratio instead of by engine input conditions. The method described in FIG. 2 is recursive in order to continually measure the sound spectrum 8 and adapt the characteristics of the first masking noise depending on engine input conditions and tone/noise amplitude ratio.

As a non-limiting example engine input condition threshold values for a combustion engine can be:

engine rpm threshold value: between 800 rpm and 6500 rpm, engine torque threshold value: equal to or above 70 Nm, rotary equipment rpm threshold value: between 800 and 80000 rpm, selected gear threshold value: above second gear, vehicle speed threshold value: above 5 kph.

As a non-limiting example engine input condition threshold values for an electric motor can be:

engine rpm threshold value: between 800 rpm and 15000 rpm, engine torque threshold value: equal to or above 0 Nm, rotary equipment rpm threshold value: between 800 and 80000 rpm, selected gear threshold value: above second gear, vehicle speed threshold value: above 5 kph.

Regarding engine input conditions for an electric motor, engine input conditions and engine input condition threshold values correspond to motor input conditions and motor condition threshold values where applicable.

Figure 3:
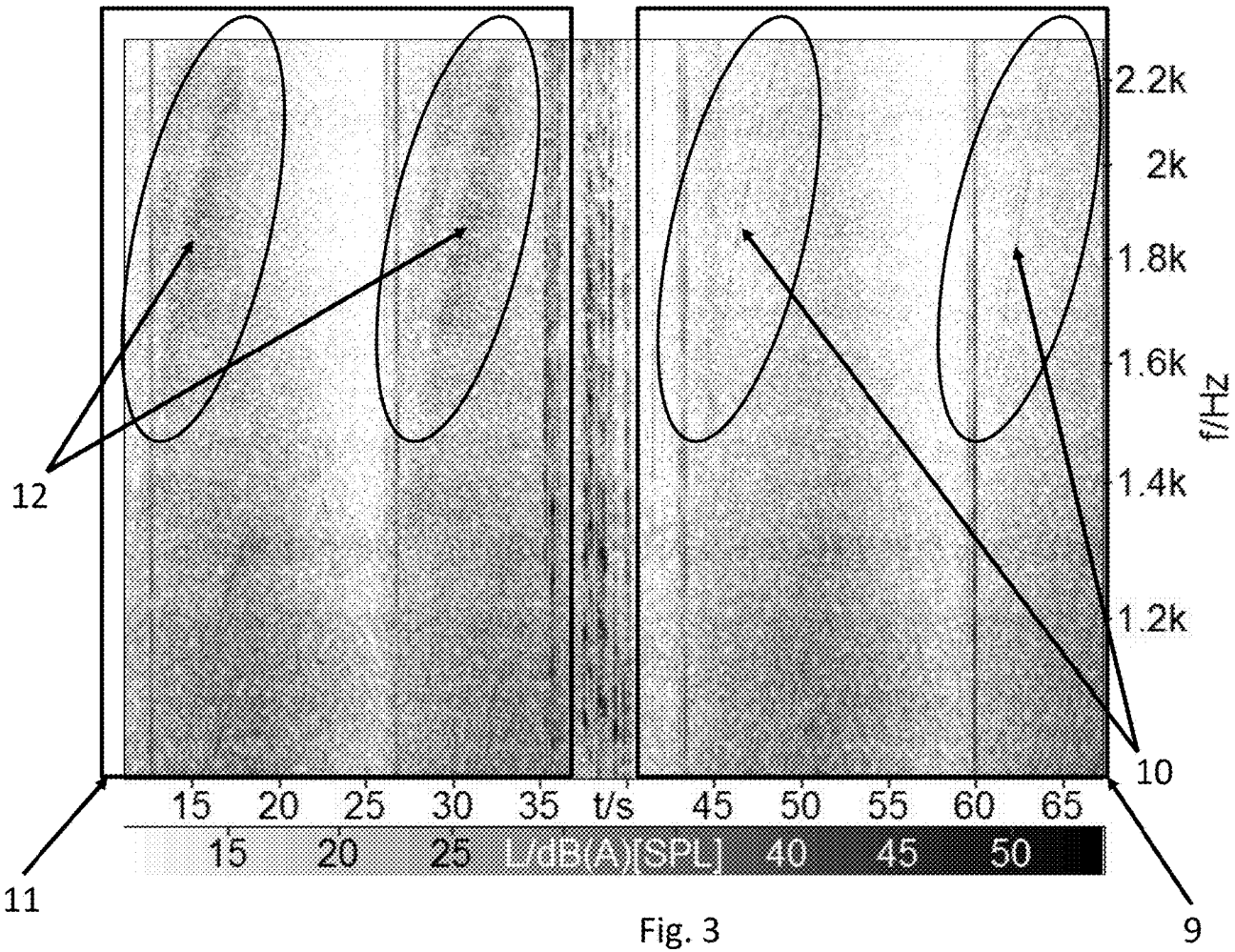
FIG. 3 shows a sound spectrum measured inside a compartment of a vehicle with and without the system according to the disclosure.

FIG. 3 shows a sound spectrum measured inside a compartment of a vehicle with and without the system according to the disclosure active. The x-axis displays time passed in seconds. The Y-axis displays frequency in Hz. The intensity bar below the x-axis displays the sound level in dB(A). A darker colour means a higher sound level.

In frame 9, i.e. the right part of the spectrum two distinct lines 10 can be seen. The lines are encircled in order to be more visible. These lines illustrate a single tone with rising frequency over time. The rising frequency illustrates an increase in for instance engine rpm and/or rotary equipment rpm causing the tone to change frequency.

In frame 11, i.e. the left part of the spectrum no distinct lines can be seen. Instead a darker area 12 is seen covering the same frequency range as the tones in frame 9. This illustrates that the system is active and that surrounding frequencies have a similar sound level as the tone, resulting in that no single tone is perceived. The system masks the distinct tone by adding surrounding frequencies with a certain sound level.

The above description can be extended to any number of tones. One band pass filtered signal can be provided for each tone. Alternatively, one band pass filtered noise signal can cover more than one tone thereby reducing the need to provide one masking noise for each tone. Additionally, the masking noise does not need to be provided by a band pass filtered signal. The masking noise may for instance be pre-recorded noise files which are matched to engine input conditions in order to output the correct masking noise with the correct amplitude. The masking noise can be outputted by the vehicle's sound system speakers located in the compartment. Additionally, one or more speakers can be placed in the engine compartment in order to enhance the output of the masking noise. Alternative tone/noise amplitude ratios other than TNR and PR are also possible to use.

As will be realized, the disclosure is capable of modification in various obvious respects, all without departing from the scope of the appended claims. Accordingly, the drawings and the description are to be regarded as illustrative in nature, and not restrictive.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A method for masking noise originating from rotary equipment in a vehicle engine, the method comprising:

checking if one or more engine input conditions fulfill one or more engine input condition threshold values; and if the one or more engine input conditions fulfill the one or more engine input condition threshold values, measuring a sound spectrum originating from the rotary equipment and the vehicle engine inside a compartment by means of at least one microphone;

calculating a first tone/noise amplitude ratio between the amplitude of a first specific noise frequency determined by the input conditions and the amplitude of ambient sound in a DSP from the measured sound spectrum; and if the first tone/noise amplitude ratio exceeds a predetermined tone/noise amplitude ratio threshold value, outputting a first masking noise from the at least one speaker, wherein the first masking noise comprises a first central frequency, a first bandwidth and a first amplitude, wherein the first central frequency is the first specific noise frequency, and the first amplitude is determined by the tone/noise amplitude ratio.

2. The method according to claim 1 further comprising:

checking in an ECU the one or more engine input conditions fulfill engine input condition threshold values, if the one or more engine input conditions fulfill the engine input conditions threshold values, providing from the ECU to a DSP comprising a noise generator and at least one band pass filter the engine input conditions;

providing from the DSP to the noise generator a first masking noise signal, wherein the first masking noise signal is a band pass filtered noise signal; and outputting a first masking noise from the at least one speaker having a frequency spectrum matching the provided band pass filtered noise signal by means of the noise generator.

3. The method according to claim 1 further comprising outputting a second masking noise from the at least one speaker together with the first masking noise, wherein the second masking noise comprises a second central frequency, a second bandwidth and a second amplitude, wherein the second central frequency is correlated to the engine input conditions and the second amplitude is correlated to the engine input conditions or a calculated second tone/noise amplitude ratio between the amplitude of a second specific noise frequency and the amplitude of ambient sound in a DSP from the measured sound spectrum.

4. The method according to claim 1 further comprising calculating a first tone/noise amplitude ratio between the amplitude of a first specific noise frequency determined by the input conditions and the amplitude of ambient sound in a DSP from the measured sound spectrum, where the tone/noise amplitude ratio is tone-to-noise ratio (TNR) or prominence ratio (PR), wherein the tone/noise amplitude ratio threshold value is dependent on engine input conditions and the tone/noise amplitude ratio threshold value is between 0 and 10 dB.

5. The method according to claim 1 wherein the engine input conditions are one or more of engine rpm, engine torque, rotary equipment rpm, selected gear, vehicle speed and throttle position, and wherein an engine rpm threshold value is between 800 rpm and 15000 rpm, an engine torque threshold value is equal to or above 70 Nm, a rotary equipment rpm threshold value is between 800 and 80000 rpm, a selected gear threshold value is above second gear, and a vehicle speed threshold value is above 5 kph.

6. The method according to claim 1 further comprising calculating a first tone/noise amplitude ratio between the amplitude of a first specific noise frequency determined by the input conditions and the amplitude of ambient sound in a DSP from the measured sound spectrum, where the tone/noise amplitude ratio is tone-to-noise ratio (TNR) or prominence ratio (PR), wherein the tone/noise amplitude ratio threshold value is dependent on engine input conditions and the tone/noise amplitude ratio threshold value is between 0 and 6 dB.

7. A system for masking noise originating from rotary equipment in a vehicle engine, the system comprising:

means for checking if engine input conditions fulfill engine input condition threshold values;

at least one speaker;

means for generating noise to be output by the at least one speaker;

wherein, if one or more engine input conditions fulfill one or more of the engine input condition threshold values, the system is configured to output a first masking noise, wherein the first masking noise has a first central frequency, a first bandwidth and a first amplitude, and wherein the first central frequency and the first amplitude are determined by the input conditions; and at least one microphone to measure a sound spectrum inside a compartment, wherein the system is configured to calculate a first tone/noise amplitude ratio between the amplitude of a first specific noise frequency determined by the input conditions and the amplitude of ambient sound in a DSP from the measured sound spectrum and, if the tone/noise amplitude ratio exceeds a predetermined tone/noise amplitude ratio threshold level, output a first masking noise from the at least one speaker, wherein the first masking noise has a first central frequency, a first bandwidth and a first amplitude, and wherein the first central frequency is the first specific noise frequency, and the first amplitude is determined by the tone/noise amplitude ratio.

8. The system according to claim 7 wherein the means for checking if engine input conditions fulfill engine input condition threshold values comprises an ECU, and the system is configured to provide engine input conditions from the ECU to a DSP comprising a noise generator and at least one band pass filter, provide a first masking noise signal from the DSP to the noise generator, wherein the first masking noise signal is a band pass filtered noise signal, and output a first masking noise from the speaker having a frequency spectrum matching the provided band pass filtered noise signal by means of the noise generator.

9. The system according to claim 7 wherein the system is configured to output a second masking noise from the at least one speaker together with the first masking noise, wherein the second masking noise has a second central frequency, a second bandwidth and a second amplitude, wherein the second central frequency is correlated to the engine input conditions and the second amplitude is correlated to the engine input conditions or a calculated second tone/noise amplitude ratio between the amplitude of a second specific noise frequency and the amplitude of ambient sound in a DSP from the measured sound spectrum.

10. The system according to claim 7 wherein the first masking noise has a bandwidth between 3% and 30% of the first central frequency distributed evenly around the central frequency.

11. The system according to claim 9 wherein the second masking noise has a bandwidth between 3% and 30% of the first central frequency distributed evenly around the central frequency.

12. The system according to claim 7 wherein a first tone/noise amplitude ratio between the amplitude of a first specific noise frequency determined by the input conditions and the amplitude of ambient sound is calculated in a DSP from the measured sound spectrum, where the tone/noise amplitude ratio is tone-to-noise ratio (TNR) or prominence ratio (PR), and wherein the tone/noise amplitude ratio threshold value is dependent on engine input conditions and the tone/noise amplitude ratio threshold value is between 0 and 10 dB.

13. The system according to claim 7 wherein the input conditions are one or more of engine rpm, engine torque, rotary equipment rpm, selected gear and vehicle speed, and wherein an engine rpm threshold value is between 800 rpm and 15000 rpm, an engine torque threshold value is equal to or above 70 Nm, a rotary equipment rpm threshold value is between 800 and 80000 rpm, a selected gear threshold value is above second gear, and a vehicle speed threshold value is above 5 kph.

14. The system according to claim 7 wherein a first tone/noise amplitude ratio between the amplitude of a first specific noise frequency determined by the input conditions and the amplitude of ambient sound is calculated in a DSP from the measured sound spectrum, where the tone/noise amplitude ratio is tone-to-noise ratio (TNR) or prominence ratio (PR), and wherein the tone/noise amplitude ratio threshold value is dependent on engine input conditions and the tone/noise amplitude ratio threshold value is between 0 and 6 dB.

15. A system for masking noise originating from rotary equipment in a vehicle engine, the system comprising:

means for checking if engine input conditions fulfill engine input condition threshold values;

means for generating noise to be output by at least one speaker;

wherein, if one or more engine input conditions fulfill one or more of the engine input condition threshold values, the system is configured to output a first masking noise, wherein the first masking noise has a first central frequency, a first bandwidth and a first amplitude, and wherein the first central frequency and the first amplitude are determined by the input conditions; and at least one microphone to measure a sound spectrum inside a compartment, wherein the system is configured to calculate a first tone/noise amplitude ratio between the amplitude of a first specific noise frequency determined by the input conditions and the amplitude of ambient sound in a DSP from the measured sound spectrum and, if the tone/noise amplitude ratio exceeds a predetermined tone/noise amplitude ratio threshold level, output a first masking noise from the at least one speaker, wherein the first masking noise has a first central frequency, a first bandwidth and a first amplitude, and wherein the first central frequency is the first specific noise frequency, and the first amplitude is determined by the tone/noise amplitude ratio.

16. The system according to claim 15 wherein the means for checking if engine input conditions fulfill engine input condition threshold values comprises an ECU, and the system is configured to provide engine input conditions from the ECU to a DSP comprising a noise generator and at least one band pass filter, provide a first masking noise signal from the DSP to the noise generator, wherein the first masking noise signal is a band pass filtered noise signal, and output a first masking noise from the speaker having a frequency spectrum matching the provided band pass filtered noise signal by means of the noise generator.

17. The system according to claim 15 wherein the system is configured to output a second masking noise from the at least one speaker together with the first masking noise, wherein the second masking noise has a second central frequency, a second bandwidth and a second amplitude, wherein the second central frequency is correlated to the engine input conditions and the second amplitude is correlated to the engine input conditions or a calculated second tone/noise amplitude ratio between the amplitude of a second specific noise frequency and the amplitude of ambient sound in a DSP from the measured sound spectrum.

* * * * *